United States Patent [19]

Piber

[11] 4,135,069

[45] Jan. 16, 1979

[54] COMPLETELY INSULATED TOGGLE SWITCH

[75] Inventor: Earl T. Piber, Oconomowoc, Wis.

[73] Assignee: Cutler-Hammer, Inc., Milwaukee, Wis.

[21] Appl. No.: 745,468

[22] Filed: Nov. 26, 1976

[51] Int. Cl.[2] ..... H01H 5/28

[52] U.S. Cl. ..... 200/67 G; 200/68; 200/303; 200/335

[58] Field of Search ..... 200/67 G, 68, 77, 296, 200/303, 339, 335, 67 D, 67 DA

[56] References Cited

U.S. PATENT DOCUMENTS

| | | | |
|---|---|---|---|
| 2,824,197 | 2/1958 | Bolek | 200/67 D |
| 3,339,041 | 8/1967 | Rogero | 200/67 G |
| 3,412,225 | 11/1968 | Rogers et al. | 200/168 |
| 3,941,965 | 3/1976 | Piber | 200/296 |

*Primary Examiner*—Samuel W. Engle

*Assistant Examiner*—Ralph Palo

*Attorney, Agent, or Firm*—Hugh R. Rather; William A. Autio; Michael E. Taken

[57] ABSTRACT

A toggle switch having an insulating housing that completely encloses all metal parts enabling connection of "live" wires to the switch terminals safely. The housing includes a molded base and a molded snap-in cover. A toggle lever supporting bushing is clamped between the base and cover and is provided with a snap-in collar for snap-in mounting the switch in a hole in a mounting panel. The toggle lever actuates an over-center wire link that imparts shear and wiping motion and snap-action to butt contacts. The terminals have insulation shearing slots into which unstripped wires are forced to make electrical connections. An integrally molded plug overlies a hole in the cover and is connected to the cover by thin sections which break when the plug is depressed into such hole to force the wires into the connectors.

8 Claims, 9 Drawing Figures

COMPLETELY INSULATED TOGGLE SWITCH

BACKGROUND OF THE INVENTION

Toggle switches of the completely insulated type have been known heretofore. For example, my copending application Ser. No. 745,475, filed Nov. 26, 1976, now U.S. Pat. No. 4,081,641, dated Mar. 28, 1978, discloses a snap-action toggle switch of the completely insulated type having a one-piece foldable housing, a snap-in mounting bushing for supporting the toggle lever and mounting the switch in a hole in a mounting panel, and insulation piercing terminals that may be connected to unstripped conductors by pressing closed an integrally molded partly-open door on one of the housing parts. While this prior switch is useful for its intended purpose, this invention provides an alternative switch structure having certain desirable features hereinafter described.

SUMMARY OF THE INVENTION

An object of the invention is to provide an improved toggle switch.

A more specific object of the invention is to provide an improved completely-insulated toggle switch having an insulating housing including a base and a snap-in cover and an integrally-molded plug held to the cover by severable thin sections that break when the plug is depressed into a hole in the cover to connect conductors to the switch terminals without any exposed metal parts.

Another specific object of the invention is to provide a toggle switch of the aforementioned type with snap-action butt contacts having limited shear and wiping motion to keep them clean.

Another specific object of the invention is to provide a toggle switch of the aforementioned type with insulation shearing terminals and means enabling connection of unstripped conductors thereto without exposing any metal parts.

Another specific object of the invention is to provide a toggle switch of the aforementioned type with a snap-in bushing for mounting the switch in a hole in a mounting panel which bushing is clamped between the housing and cover.

Another specific object of the invention is to provide a toggle switch of the aforementioned type that is simple in construction and economical to manufacture.

Other objects and advantages of the invention will hereinafter appear.

DESCRIPTION OF THE PREFERRED EMBODIMENT

Figure 1:
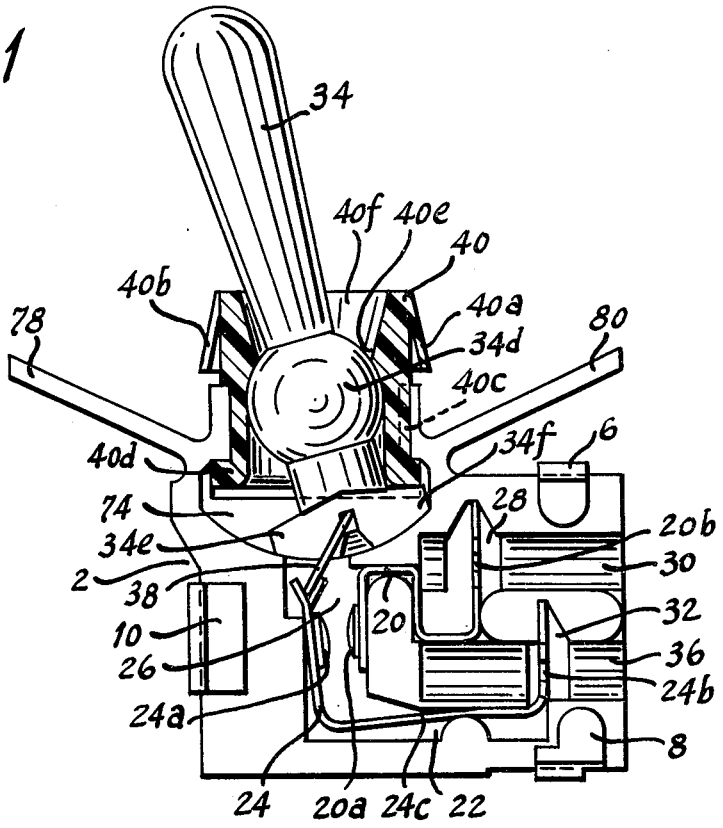
FIG. 1 is an enlarged view of the toggle switch on a vertical plane with the snap-in bushing in section and the cover removed to show the switch parts assembled into the cavities in the base.
Figure 2:
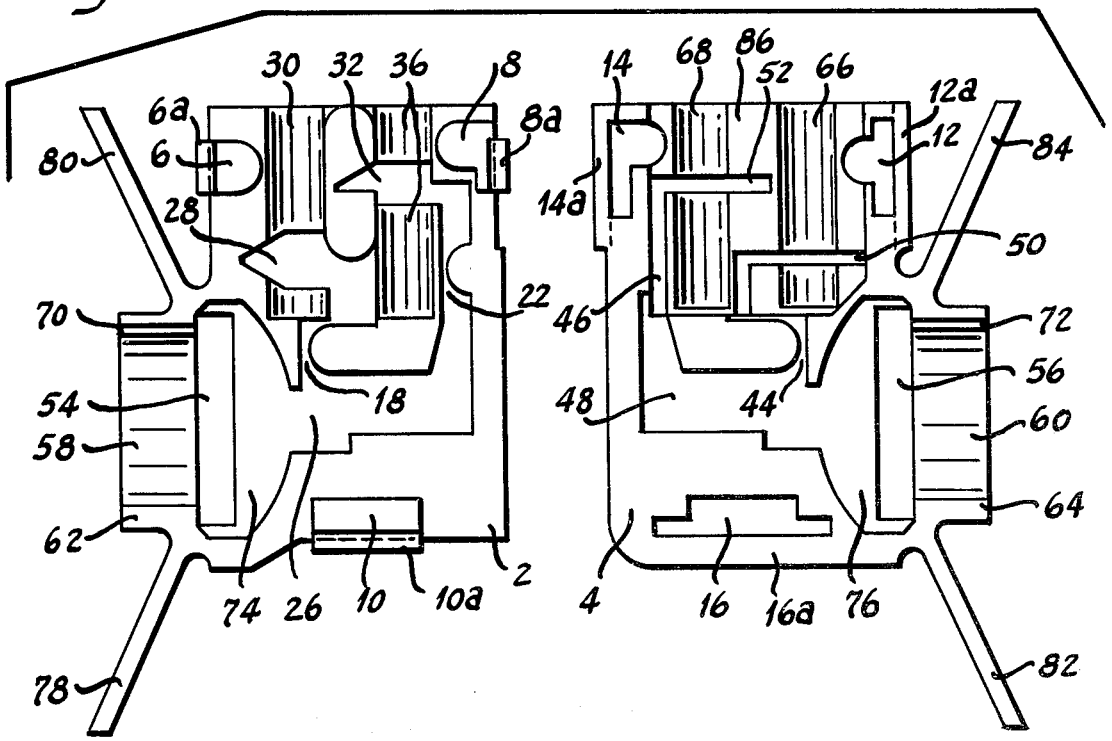
FIG. 2 is an enlarged view of the toggle switch housing parts showing the interior cavities of the base and cover.
Figure 3:
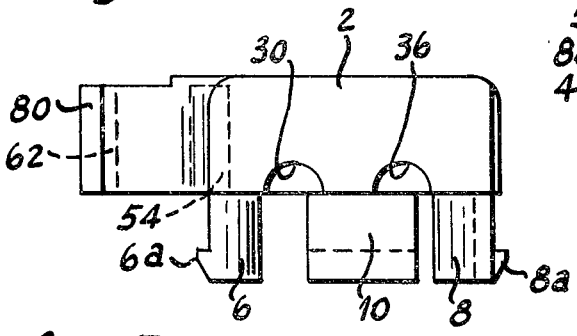
FIG. 3 is a top view of the base of FIG. 2 showing the snap-in hooks that join with the cover.
Figure 4:
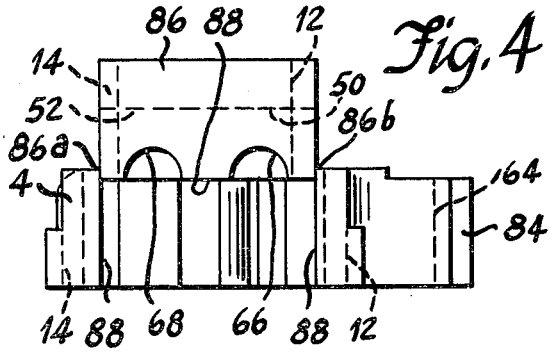
FIG. 4 is a top view of the cover of FIG. 2 showing the integrally-molded plug connected by severable thin sections to the cover.
Figure 5:
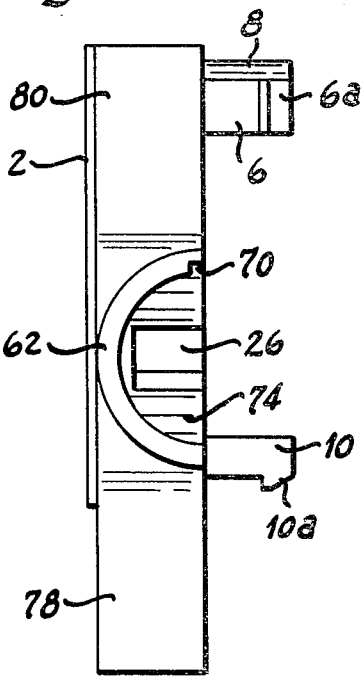
FIG. 5 is a left side view of the base of FIG. 2 showing the back-up wings and half of the cylindrical collar that retains the snap-in bushing.
Figure 6:
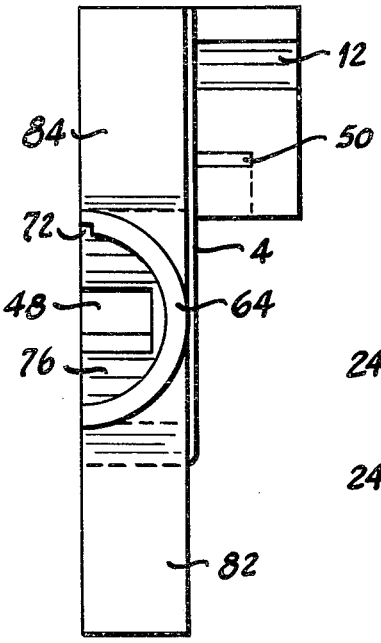
FIG. 6 is a right side view of the cover of FIG. 2 showing the back-up wings and the other half of the cylindrical collar that retains the snap-in bushing.

Referring to FIGS. 1–9, there is shown a completely insulated toggle switch constructed in accordance with the invention. As shown in FIG. 2, the switch is provided with an insulating housing comprising two complementary parts including a base 2 and a cover 4 for snap-in coupling with the base. For this purpose, the base is provided with three integrally-molded projections 6, 8 and 10, each having a catch, 6*a*, 8*a* and 10*a*, at the end thereof as shown in FIGS. 2, 3 and 5. These projections are suitably spaced about base 2 and are arranged for insertion into respective holes 12, 14 and 16 in cover 4 wherein their catches effect snap-in engagement when the cover is pressed to the base. As shown in FIG. 2, holes 12, 14 and 16 are provided with sufficient length so that the plastic strip, 12*a*, 14*a* and 16*a*, between each hole and the edge of the cover has sufficient resiliency to admit the corresponding catch past it and then snap behind the catch to rigidly secure the cover to the base.

Base 2 is provided with means for retaining the switch contacts therein. This means comprises a slot 18 for retaining a stationary contact 20 and a slot 22 for retaining a movable contact 24 as shown in FIGS. 1 and 2. This stationary contact 20 is provided with a contact element 20*a* at one end within switch compartment 26 as shown in FIG. 1 and is provided with a terminal notch 20*b* at its other terminal end as more clearly shown in FIG. 8, this terminal end being located within terminal cavity 28 in base 2. As shown in FIG. 1, terminal cavity 28 communicates with a semi-cylindrical conductor cavity 30 that extends to the right edge of the base.

Figure 7:
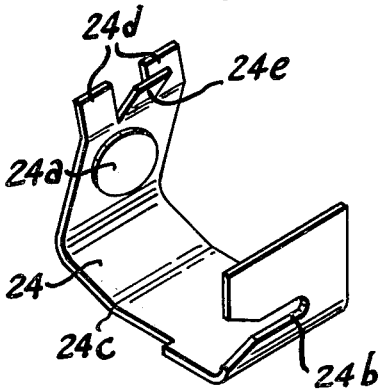
FIG. 7 is an isometric view of the movable contact of FIG. 1 including its insulating-shearing terminal portion.

The aforementioned movable contact 24 is provided with a contact element 24*a* at one end within switch compartment 26 as shown in FIG. 1 and is provided with a terminal notch 24*b* at its other terminal end as more clearly shown in FIG. 7, this terminal being located within terminal cavity 32 in base 2. In its relaxed condition shown in FIG. 7, the contact-element-carrying half of the movable contact is bent slightly up at its midportion 24*c* to give it sufficient upward bias for snap-action closing when assembled as shown in FIG. 1. This small bend causes the upstanding contact element carrying end portion to lean toward the right and to be self-biased into engagement with the stationary contact when toggle lever 34 is in closed position. As shown in FIG. 1, terminal cavity 32 communicates with a semi-cylindrical conductor cavity 36 that extends to the right edge of the base.

Figure 9:
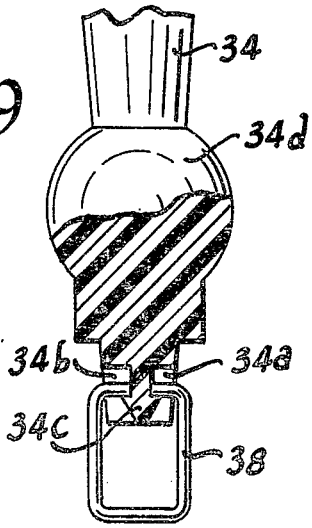
FIG. 9 is a further enlarged fragmentary view, partly in lateral section, of the lower end portion of the toggle lever of FIG. 1 showing the toggle link assembled thereon.
Figure 8:
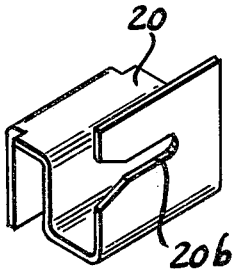
FIG. 8 is an isometric view of the stationary contact of FIG. 1 including its insulation-shearing terminal portion.

The switch is provided with snap-action means for closing and opening the contacts. This means comprises an overcenter toggle link 38 and means coupling this link to the toggle lever and the movable contact as shown in FIGS. 1, 7 and 9. This link comprises round spring wire such as music wire or the like formed into a rectangle with the ends of the wire slightly spaced apart symmetrically at one end of such rectangle as shown in FIG. 9. The lower end of the toggle lever is provided with a pair of lateral recesses 34*a* and 34*b* opposite one another as shown in FIG. 9. The portion of the toggle lever below these recesses is grooved to a V-shaped configuration 34*c* leading to these recesses so that the opening in link 38 may be conveniently pushed up the inclined surfaces of this V-shaped configuration and in doing so the ends of link 38 are spread apart and snap into recesses 34*a* and 34*b* to be retained therein for limited pivotal movement.

The opposite closed end of the aforementioned rectangular wire link 38 is seated in a cradle formed on the upstanding end of movable contact 24. To form this cradle, the end of the movable contact strip is provided with two spaced-apart, short cuts to provide a pair of lateral tabs 24*d* separated by a center tab 24*e* as shown in FIG. 7. The lateral tabs are bent slightly to the left and the center tab is bent slightly to the right to form a cradle for link 38.

When link 38 is assembled on the toggle lever and the subassembly including snap-in bushing 40 and toggle lever 34 is placed in base 2 as shown in FIG. 1, link 38 forces the upstanding contact element carrying end portion of movable contact 24 to be forced slightly down and toward the left against its upward bias and to its contacts open position. As shown in FIG. 1, the mid-portion 24*c* upward bend is substantially straightened or bowed slightly down to afford the required force for snap-action operation.

Cover 4 has complementary cavities and slots for the switch parts including a slot 44 for stationary contact 20, a slot 46 for movable contact 24, a switch compartment 48, a terminal cavity 50 for the terminal of stationary contact 20, and a terminal cavity 52 for the terminal of movable contact 24, these terminal cavities being in the offset plug hereinafter described.

Base 2 and cover 4 are also provided with complementary semi-circular grooves 54 and 56, respectively, for retaining the snap-in bushing as hereinafter described, and complementary semi-cylindrical portions 58 and 60, respectively, providing a round bore within the collar 62, 64 therearound for embracing the snap-in bushing.

Cover 4 is further provided with semi-cylindrical conductor cavities 66 and 68 in the aforementioned offset plug communicating with terminal slots 50 and 52, respectively, these cavities extending to the corresponding edge of the cover on the interior of the press-in plug hereinafter described.

The toggle switch is provided with means for mounting the toggle lever in the housing and for snap-in mounting the switch in a hole in a mounting panel. This means comprises snap-in bushing 40. As shown in FIG. 1, this bushing is generally tubular in form and has an integrally-molded snap-in skirt 40*a* at its upper end, this skirt extending downwardly from the top of the bushing and flaring outwardly. Thus, as this skirt is pushed through the hole in the mounting panel, it will snap out again on the other side to abut the rim of the hole and lock the switch to the panel. This bushing is provided with a keyway 40*b* in one side of this skirt for receiving a key integral with the mounting panel at the edge of the hole therein thereby to mount the switch non-rotatably on the panel. This bushing is also provided with an integrally molded key 40*c* along one side thereof as shown in FIG. 1 to fix it non-rotatably in keyway 70, 72 (FIG. 2) within the housing bore as shown in FIG. 1. This bushing is also provided with a preformed annular flange 40*d* at its lower (or internal) end for rigidly securing the bushing in complementary semi-circular grooves 54 and 56 in the housing and cover when they are snapped together. This preformed annular flange may be formed in a special jig after the bushing has been molded. That is, the lower end of the bushing must be molded straight in order to get the mold out from beneath snap-in skirt 40*a*. Thereafter, this molded bushing is placed in a special jig and flange 40*d* is formed thereon by ultra-sonic means or the like.

The bushing is further provided with a constriction 40*e* molded within its bore 40*f* to serve as a pivotal seat for enlarged spherical portion 34*d* of the toggle lever. The toggle lever is provided with left and right projections 34*e* and 34*f* that serve as stops against the opposite inner walls of cavities 74 and 76 in the housing and cover as shown in FIGS. 1 and 2.

For cooperation with the aforementioned snap-in bushing, there are provided a pair of resilient, integrally-molded backup elements 78 and 80 extending in opposite directions with upward angles from base 4 at the root of collar half 62. A similar pair of back-up elements 82 and 84 complementary to the first pair are integrally molded on cover 4. Thus, when the cover is snapped on the base, the two pairs of back-up elements become lined up to, in effect, form two double-width back-up elements. These back-up elements are bowed down when the snap-in skirt of the bushing is pushed through the hole in the mounting panel and press against the back of the panel to keep the flared snap-in skirt tightly drawn up against the front of the panel as more fully disclosed in my U.S. Pat. No. 3,941,965, dated Mar. 2, 1976, and assigned to the assignee of this invention.

The switch is provided with means for connecting unstripped insulated conductors to the terminals without exposing any metal parts thereby enabling connection of "live" wires safely. This means comprises an integrally molded plug 86 overlying a hole 88 in the cover and the terminal slots and conductor cavities in the base. This plug is molded so that it is attached by thin sections 86*a* and 86*b* at its opposite sides to cover 4 as shown in FIG. 4. These thin sections 86*a* and 86*b* are such as to keep plug 86 attached to the cover but thin enough so that they will readily break when the plug is pressed into the hole to connect conductors to the contacts.

For this purpose, it will be apparent from FIGS. 3 and 4 that when cover 4 is snap-in assembled to base 2, large, generally rectangular hole 88, FIG. 4, will remain open to the end of the housing, including conductor cavities 30 and 36 on one side thereof and conductor cavities 66 and 68 on the inner surface of the plug on the other side thereof. The contact terminals including their insulation shearing notches 20*b* and 24*b* will be visible within this hole. This allows a pair of insulated, unstripped conductors to be inserted into this hole so that they rest on the beveled edges at the entrances to notches 20*b* and 24*b* and stop against the inner ends of conductor cavities 30 and 36 in the base. Plug 86 is then pressed into its tight-fitting hole 88. This can be done by squeezing with a pair of pliers or the like. This causes thin sections 86*a* and 86*b* to break, thus allowing the plug to slide into cover 4 to close rectangular hole 88.

At this is done, conductor cavities 66 and 68 in plug 86 embrace the conductors and press them into notches 20*b* and 24*b*. The beveled edges at the mouth of these notches shear (or cut) the insulation and flatten the round stranded conductors therewithin so that these conductors are squeezed into notches 20*b* and 24*b* for good electrical connections. In this pressed-in position of plug 86, conductor cavity 66 joins with conductor cavity 30 to provide a cylindrical space for one of the conductors. In a similar manner, conductor cavity 68 joins with conductor cavity 36 to provide a cylindrical space for the other conductor. Terminals cavities 50 and 52 in the interior surface of plug 86 provide clearance for the contact terminals to allow the plug to be pressed in.

The switch is shown in its off, or contacts open, position in FIG. 1. In this position, movable contact 24 biases link 38 upwardly whereby the toggle lever is rotated all the way counter-clockwise wherein projection 34*f* at the lower end of the toggle lever abuts the right-hand wall of cavity 74 as shown in FIG. 1.

When the toggle lever is actuated clockwise to its on, or contacts closed position, the lower end of the toggle lever swings leftward. This causes link 38 to push the movable contact down against its bias until link 38 passes over center. At this point, the upward bias of the movable contact causes toggle action or snap-action closing of the contacts. For this purpose, link 38 flips the lower end of the toggle lever leftward until projection 34*e* abuts the left wall of cavity 74 and the upward and rightward bias of the movable contact causes it to move along the arc of link 38 into engagement with the stationary contact to close the switch.

When the toggle lever is actuated counter-clockwise, the switch is opened with a snap action. For this purpose, when the toggle lever moves the upper end of link 38 toward center, the movable contact is pushed down thereby causing contact element 24*a* to slide down along contact element 20*a*. This wiping action of limited extent tends to keep the contacts clean so that good electrical contact will be made. This pushing of movable contact element 24*a* downward with respect to stationary contact element 20*a* also imparts shear force to break any weld that might occur between the contacts thereby to insure opening of the switch. Thereupon when link 38 passes overcenter, the bias provided by the movable contact snaps the movable contact to the open position shown in FIG. 1.

While the apparatus hereinbefore described is effectively adapted to fulfill the objects stated, it is to be understood that the invention is not intended to be confined to the particular preferred embodiment of completely insulated toggle switch disclosed, inasmuch as it is susceptible of various modifications without departing from the scope of the appended claims.

I claim:

1. A completely insulated toggle switch comprising:

a two-piece insulating housing having complementary parts including a base and a cover and snap-in coupling means for mounting the cover to the base, and a switch contact cavity and terminal cavities connected to said switch contact cavity therewithin;

stationary contact means in said switch contact cavity and having a terminal portion extending into its terminal cavity;

movable contact means in said switch contact cavity and having a terminal portion extending into its terminal cavity;

a snap-in bushing clamped between said housing parts and having external snap-in means for mounting the switch in a hole in a mounting panel;

a toggle lever mounted in said snap-in bushing and having means supporting a pivotal toggle link at its internal end within said switch contact cavity;

means coupling said toggle link to said movable contact means pivotally with interference requiring depression of said movable contact means to enable over-center movement of said toggle link; said movable contact means comprising spring bias whereby said toggle link slides said movable contact means and snaps it into open position with respect to said stationary contact means when said toggle lever is actuated to off position, and said bias causing snap-action of said toggle link to effect closure of said movable contact means with respect to said stationary contact means when said toggle lever is actuated to on position;

insulation cutting means on said terminal portions;

and means in said cover overlying said terminal cavities allowing insertion of unstripped insulated conductors over said terminal portions and depression thereof by pressure applied externally of the housing to make electrical connections.

2. The completely insulated toggle switch claimed in claim 1, wherein:

said housing around said terminal cavities completely surrounds said terminal portions except for an opening admitting said conductors whereby all live parts are insulated for safety.

3. The completely insulated toggle switch claimed in claim 1, wherein:

said stationary contact means comprises a contact strip formed for fixed retention in a slot in said base.

4. The completely insulated toggle switch claimed in claim 1, wherein:

said movable contact means comprises a contact strip fixed in a slot in said base and including a resilient portion within said switch contact cavity stressed by said toggle link and providing bias for snap-action operation thereof between open and closed positions when said toggle lever is actuated.

5. The completely insulated toggle switch claimed in claim 1, wherein:

said snap-in bushing comprises a preformed annular flange on its internal end and said base and cover comprise semicircular grooves for retaining said flange when said cover is snap-in mounted to said base.

6. The completely insulated toggle switch defined in claim 1, wherein:

said insulating cutting means comprises beveled, narrow slots in said terminal portions that cut the insulation and pinch the stranded conductor therewithin when said insulated conductors are forced thereinto.

7. The completely insulated toggle switch claimed in claim 1, wherein:

said means in said cover comprises an integrally-molded plug held to said cover by thin sections so as to be outwardly offset and adapted to be severed when said plug is depressed into a tight-fitting hole in said cover to make said electrical connections.

8. The completely insulated toggle switch claimed in claim 7, wherein:

said plug comprises slots on its inner surface providing clearance for said terminal portions and the unstripped insulated conductors.

* * * * *